US005361673A

United States Patent [19]

Kira et al.

[11] Patent Number: 5,361,673

[45] Date of Patent: Nov. 8, 1994

[54] ELECTRONIC MUSICAL INSTRUMENT

[75] Inventors: Yoshifumi Kira; Shinya Konishi, both of Shizuoka, Japan

[73] Assignee: Kabushiki Kaisha Kawai Gakki Seisakusho, Japan

[21] Appl. No.: 122,723

[22] Filed: Sep. 16, 1993

[30] Foreign Application Priority Data

Sep. 18, 1992 [JP] Japan ..... 4-273462

[51] Int. Cl.[5] ..... G10H 1/18; G10H 5/00

[52] U.S. Cl. ..... 84/615; 84/645

[58] Field of Search ..... 84/615–620, 84/645

[56] References Cited

U.S. PATENT DOCUMENTS 5,079,984 1/1992 Kosugi et al. ..... 84/645

5,142,959 9/1992 Sakamoto et al. ..... 84/645

*Primary Examiner*—Stanley J. Witkowski

*Attorney, Agent, or Firm*—Andrus, Sceales, Starke & Sawall

[57] ABSTRACT

An electronic musical instrument, which includes an internal tone generator, a local-on play function, which produces musical tones in consonance with tone data generated by the internal tone generator, and a local-off play function, which externally outputs only an MIDI signal without performing tone production in consonance with tone data generated by the internal tone generator. The instrument comprises first tone information storage for, when the local-on play function is selected, storing a channel that corresponds to tone data, which are generated by the internal tone generator, for each of the tone data; tone-on channel assigning circuitry for employing the tone information, which are stored in the first storage, to specify a channel that corresponds to the tone data generated by the internal tone generator; a further tone generator, which is connected to the tone channel assigning circuitry, for producing a musical tone in consonance with the tone data from the tone-on channel assigning circuitry; second tone information storage for, when the local-off play function is selected, successively storing the ON/OFF states of tone data generated by the internal tone generator for each set of the tone data; a local-off tone data control for employing the tone information stored in the second tone information storage to output, as tone data for an MIDI signal, the tone data that is generated by the internal tone generator without performing either tone channel assignment or tone production for the tone data; and a MIDI signal output, which is connected to the tone channel assigning circuitry and the local-off tone data control, for outputting, as MIDI signals, tone data from the tone channel assigning circuitry and tone data from the local-off tone data control.

16 Claims, 10 Drawing Sheets

| | | | | | | | | | |
|---|---|---|---|---|---|---|---|---|---|
| 1 OCTAVE | $C_1$ | $C\#_1$ | $D_1$ | $D\#_1$ | $E_1$ | $F_1$ | $F\#_1$ | $G_1$ | (1 BYTE) LOW TONE |
| | $G\#_1$ | $A_1$ | $A\#_1$ | $B_1$ | – | – | – | – | |
| 1 OCTAVE | $C_2$ | | | | | | | | |
| | | | | $B_2$ | – | – | – | – | |
| 1 OCTAVE | $C_3$ | | | | | | | | |
| | | | | $B_3$ | – | – | – | – | |
| 1 OCTAVE | $C_4$ | | | | | | | | |
| | | | | $B_4$ | – | – | – | – | |
| 1 OCTAVE | $C_5$ | | | | | | | | |
| | | | | $B_5$ | – | – | – | – | HIGH TONE |
| ⋮ | $C_6$ | – | – | – | – | – | – | – | |

FIG. 2

S1 : SOUND 1
S2 : SOUND 2
C : CHORD
B : BASS

ELECTRONIC MUSICAL INSTRUMENT

BACKGROUND OF THE INVENTION

1. Field of the Invention

The present invention relates to an electronic musical instrument that includes a local-on play function and a local-off play function.

2. Description of the Related Art

Generally, electronic musical instruments are well known that have a local-on play function, which performs tone production in consonance with tone data generated by an internal tone generating means, and a local-off play function, which does not perform tone production in consonance with tone data from an internal tone generating means and outputs only an MIDI signal to an external device.

Conventionally, to perform local-off playing in consonance with a keyboard tone generator, such an electronic musical instrument outputs an MIDI signal externally in response to key depression or release at the keyboard. More specifically, when at least one key on the keyboard has been depressed, the electronic musical instrument externally outputs an MIDI signal indicating that at least one key is depressed, and when at least one key of the keyboard is released, the electronic musical instrument externally outputs an MIDI signal indicating that at least one key has been released.

In a conventional electronic musical instrument which incorporates automatic play means that performs automatic playing in consonance with automatic play data, when an MIDI signal is output for tone data that is generated by an automatic play data generator of the automatic play means, i.e., when the electronic musical instrument is in an ACC-ON state (the counter condition is an ACC-OFF state), those tone data, from either the keyboard tone generator or from the automatic play data generator, in consonance with which musical tones are being produced are erased, and new selected tone data for the production of musical tones are registered. This series of processes is required following the selection, by panel operation means, of either the mode in which the keyboard tone generator is activated or the mode in which an automatic play data generator is activated, and of a mode/part, such as a tone quality and a timbre.

In other words, it is necessary to perform an assigner process, that is, a tone channel assignment, to store the ON/OFF state of specific tone data.

The assigner process for a conventional electronic musical instrument is performed on the premise that tone production in the electronic musical instrument, i.e., local-on play, is performed. The conventional electronic musical instrument, therefore, cannot execute local-off play that externally outputs tone data, which has been generated by an automatic play data generator, as an independent MIDI signal.

SUMMARY OF THE INVENTION

It is therefore an object of the present invention to provide an electronic musical instrument that can perform local-off play that externally outputs tone data, as an independent MIDI signal, which include tone data generated by an automatic play data generator, without employing that tone data for tone production.

According to the present invention, an electronic musical instrument, which includes internal tone generating means, a local-on play function, which produces musical tones in consonance with tone data generated by the internal tone generating means, and a local-off play function, which externally outputs only an MIDI signal without performing tone production in consonance with tone data generated by the internal tone generating means, comprises: first tone information storage means for, when the local-on play function is selected, storing a channel that corresponds to tone data, which are generated by the internal tone generating means, for each of the tone data; tone-on channel assigning means for employing the tone information, which are stored in the first storage means, to specify a channel that corresponds to the tone data generated by the internal tone generating means; tone generating means, which is connected to the tone channel assigning means, for producing a musical tone in consonance with the tone data from the tone-on channel assigning means; second tone information storage means for, when the local-off play function is selected, successively storing the ON/OFF states of tone data generated by the internal tone generating means for each set of the tone data; local-off tone data control means for employing the tone information stored in the second tone information storage means to output, as tone data for an MIDI signal, the tone data that is generated by the internal tone generating means without performing either tone channel assignment or tone production for the tone data; and MIDI signal output means, which is connected to the tone channel assigning means and the local-off tone data control means, for outputting, as MIDI signals, tone data from the tone channel assigning means and tone data from the local-off tone data control means.

According to the electronic musical instrument of the present invention, when the local-off play function is selected, the second tone information storage means is employed to successively store the ON/OFF states of tone data, which are generated by the internal tone generating means, for each set of the tone data. In consonance with the tone information stored in the second tone information storage means, the local-off tone data control means, without performing tone-on channel assignment, outputs that tone data, which will be used for an MIDI signal, and the MIDI signal output means outputs, as an MIDI signal, that tone data that is received from the local-off tone data control means. It is therefore possible to output only the MIDI signal without the tone data passing through the tone generating means and without employing the tone data for tone production.

BRIEF DESCRIPTION OF THE DRAWINGS

FIG. 2 is a schematic diagram for explaining the arrangement of a memory map for a keyboard scan section of the electronic musical instrument according to the present invention;

DETAILED DESCRIPTION OF THE PREFERRED EMBODIMENT

The preferred embodiment of an electronic musical instrument according to the present invention will now be described while referring to the accompanying drawings.

Figure 1:
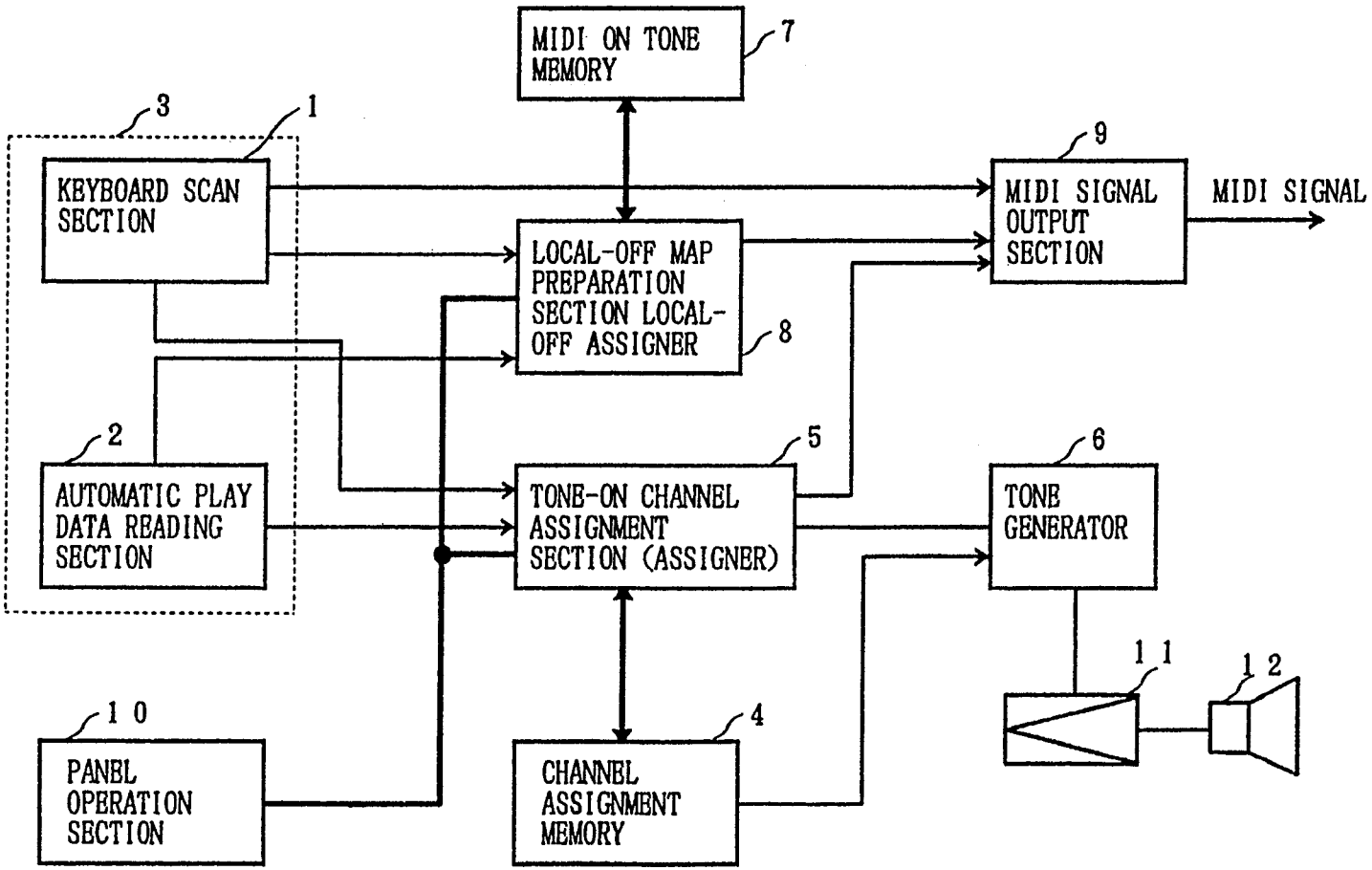
FIG. 1 is a schematic block diagram illustrating the essential arrangement of an electronic musical instrument according to the present invention.

FIG. 1 is a schematic block diagram illustrating the essential arrangement of an electronic musical instrument according to the present invention.

As shown in FIG. 1, the electronic musical instrument of the present invention comprises: internal tone generating means 3, which includes a keyboard scan section 1 that serves as a keyboard tone generator, and an automatic play data reading section 2 that serves as an automatic play data generator; a local-on play function that performs tone production in consonance with tone data generated by the internal tone generating means 3; a local-off play function that externally outputs an MIDI signal but does not perform tone production in consonance with tone data generated by the internal tone generating means 3; a channel assignment memory 4, the first tone channel assignment section, that is employed, when the local-on play function is selected, to store channels corresponding to tone data generated by the internal tone generating means 3 for each of the tone data; a tone-on channel assignment section 5, as tone-on channel assigning means, that employs tone information stored in the channel assignment memory 4 to specify a channel corresponding to tone data generated by the internal tone generating means 3; tone generator 6, as tone generating means, that is connected to the tone-on channel assignment section 5 to produce a musical tone in consonance with tone data received from the tone-on channel assignment section 5; an MIDI ON tone memory 7, as the second tone information storage means, that is employed, when the local-off play function is selected, to sequentially store the ON/OFF states of tone data generated by the internal tone generating means 3 for each of the tone data; a local-off map preparation section 8, as a local-off tone data control means, that outputs, as tone data for an MIDI signal, tone data generated by the internal tone generating means 3 but does not perform either tone-on channel assignment or tone production in consonance with the tone data; and an MIDI signal output section 9, as MIDI signal output means, that is connected to the tone-on channel assignment section 5 and the local-off map preparation section 8 to output, as an MIDI signal, tone data both from the tone-on channel assignment section 5 and tone data from the local-off map preparation section 8.

The individual components of the electronic musical instrument of the present invention are connected as is shown in FIG. 1 and as is described below.

When the local-off play function is selected and the state of the ACC is OFF, the keyboard scan section 1, of the internal tone generating means 3, is connected with and sends tone data to the MIDI signal output section 9.

When the local-off play function is selected and the state of the ACC is ON, the keyboard scan section 1 is connected with and sends tone data to the local-off map preparation section 8.

Further, when the local-on play function is selected, the keyboard scan section 1 is connected with and sends the tone data to the tone-on channel assignment section 5.

When the local-off play function is selected, the automatic play data reading section 2, of the internal tone generating means 3, is connected with and sends tone data to the local-off map preparation section 8.

And when the local-off play function is selected, the automatic play data reading section 2 is connected with and sends tone data to the tone-on channel assignment section 5.

A panel operation section 10 is connected to the tone-on channel assignment section 5 and the local-off map preparation section 8 for the selection and control of these sections.

The channel assignment memory 4 is connected with the tone-on channel assignment section 5. Tone-on channels that correspond to tone data generated by the internal tone generating means 3 are stored in the channel assignment memory 4, and when the internal tone generating means 3 transmits various tone data, a tone-on channel for that tone data is specified.

When the local-off play function is selected, the tone-on channel assignment section 5 is further connected with and sends the tone data to the MIDI signal output section 9.

The tone-on channel assignment section 5 and the channel assignment memory 4 are connected with the tone generator 6. When the local-on play function is selected, tone production is performed in consonance with data for tone-on channels that correspond to tone data from the tone-on channel assignment section 5 or the tone data from the channel assignment memory 4.

The tone generator 6 is connected to an amplifier 11, which amplifies tone data sent by the tone generator 6, and a loudspeaker 12, which externally outputs a signal it receives from the amplifier 11 as a musical tone.

The local-off map preparation section 8 is connected with the MIDI ON tone memory 7. For every mode/part that corresponds to tone data generated by the internal tone generating means 3, i.e., which is selected and set by the panel operation section 10, data for the individual keys are stored in a memory map in the MIDI ON tone memory 7. When the tone data is sent by the internal tone generating means 3, a mode/part that corresponds to the tone data is specified.

The local-off map preparation section 8 is connected with the MIDI signal output section 9, which receives the tone data that is output by the local-off map preparation section 8.

Reference the lines employed to connect the various components depicted in FIG. 1, the arrows on the thin lines are used to indicate the direction of data flow and the arrows on the thick lines are used to indicate operational control.

Figure 3:
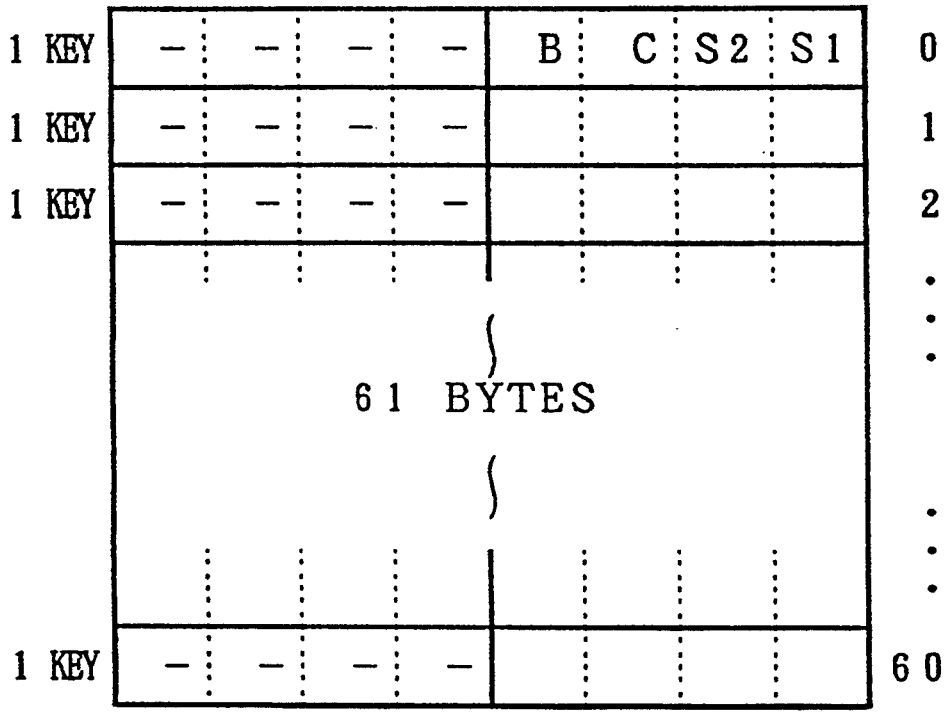
FIG. 3 is a schematic diagram for explaining the arrangement of a memory map for an automatic play data reading section of the electronic musical instrument according to the present invention.

The memory map stored in the MIDI ON tone memory 7 is arranged as shown in FIGS. 2 and 3.

When the ACC is ON and local-off playing is performed, the memory map in FIG. 2 is employed for storing tone data from the keyboard scan section 1.

In this embodiment, to set one octave in the memory map, C1, C#1, D1, D#1, E1, F1, F#1 and G1 are assigned, in order, from low tone to high tone, to the eight bits of the first byte, and G#1, A1, A#1 and B1 are assigned to the high four bits of the next byte.

The next octave is set in the third and fourth bytes in the same manner as is described above, and the third octave is set in the fifth and sixth bytes.

It is preferable that the number of octaves to be set vary in correspondence with the type and size of electronic musical instrument.

When as an example, ON-state tone data for C#1 is received from the keyboard scan section 1, the second bit from the left in the top row, the bit to which C#1 is assigned, is set to "1." When C#1 is returned and OFF-state tone data is input, the second bit from the left of the top row is set to "0."

When ACC is ON, the memory map in FIG. 3 is employed during local-off playing to store tone data from the automatic play data reading section 2.

The memory map in this example is so arranged that the individual parts are assigned to the low four bits of the eight bits in the first byte.

For example, B, bass part, is assigned to the most significant bit of the low four bits; C, chord part, is assigned to the next lower bit; S2, sound 2, is assigned to the second lower bit; and S1, sound 1, is assigned to the least significant bit.

Similarly to the memory map, which is employed to store data in consonance with tone data from the keyboard scan section 1, when, for example, ON-state tone data for bass B is received from the automatic play data reading section 2, the fifth bit from the left in the top row, the bit to which the bass B is assigned, is set to "1." When OFF-state tone data for bass B is received, the fifth bit of from the left in the top row is reset to "0."

Since the eight bits of one byte are assigned for a single key of the keyboard, it is apparent that the assignments in the memory map in FIG. 3 correspond to 61 keys.

Processing performed for the preferred embodiment of the electronic musical instrument of the present invention will now be explained.

Figure 4:
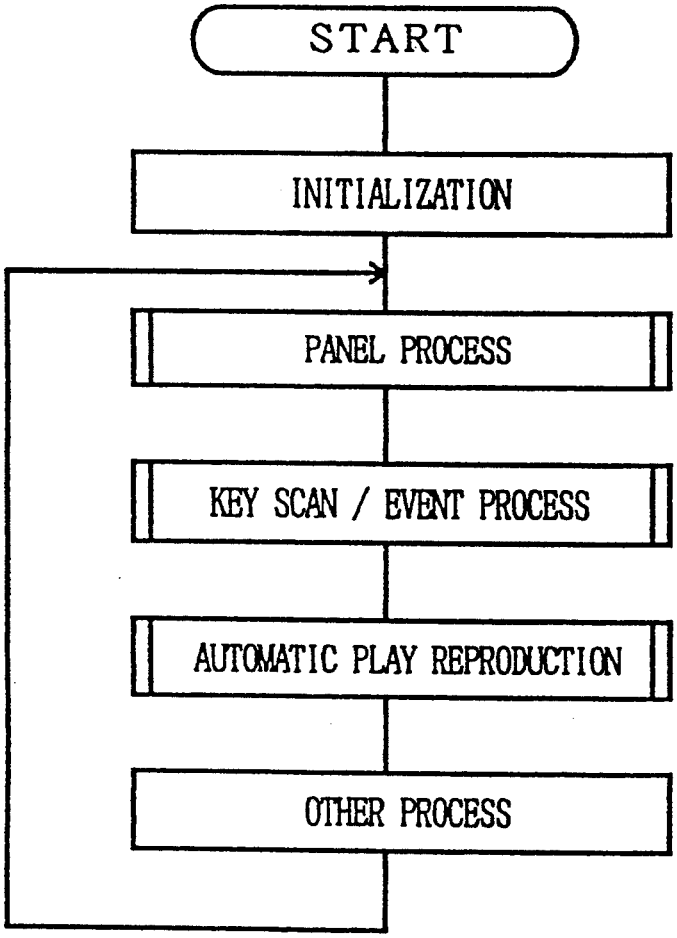
FIG. 4 is a flowchart graphically depicting the processing performed by the electronic musical instrument according to the present invention.

As shown in FIG. 4, when the electronic musical instrument of the present invention is activated, execution of a program is begun. After a predetermined initialization is performed, a panel operation process for the panel operation section 10, a keyboard scan/event process for the keyboard scan section 1, automatic play reproduction for the automatic play data reading section 2, and other processes are performed. The program execution control then returns to the panel operation process and the above described processing is repeated.

Figure 5:
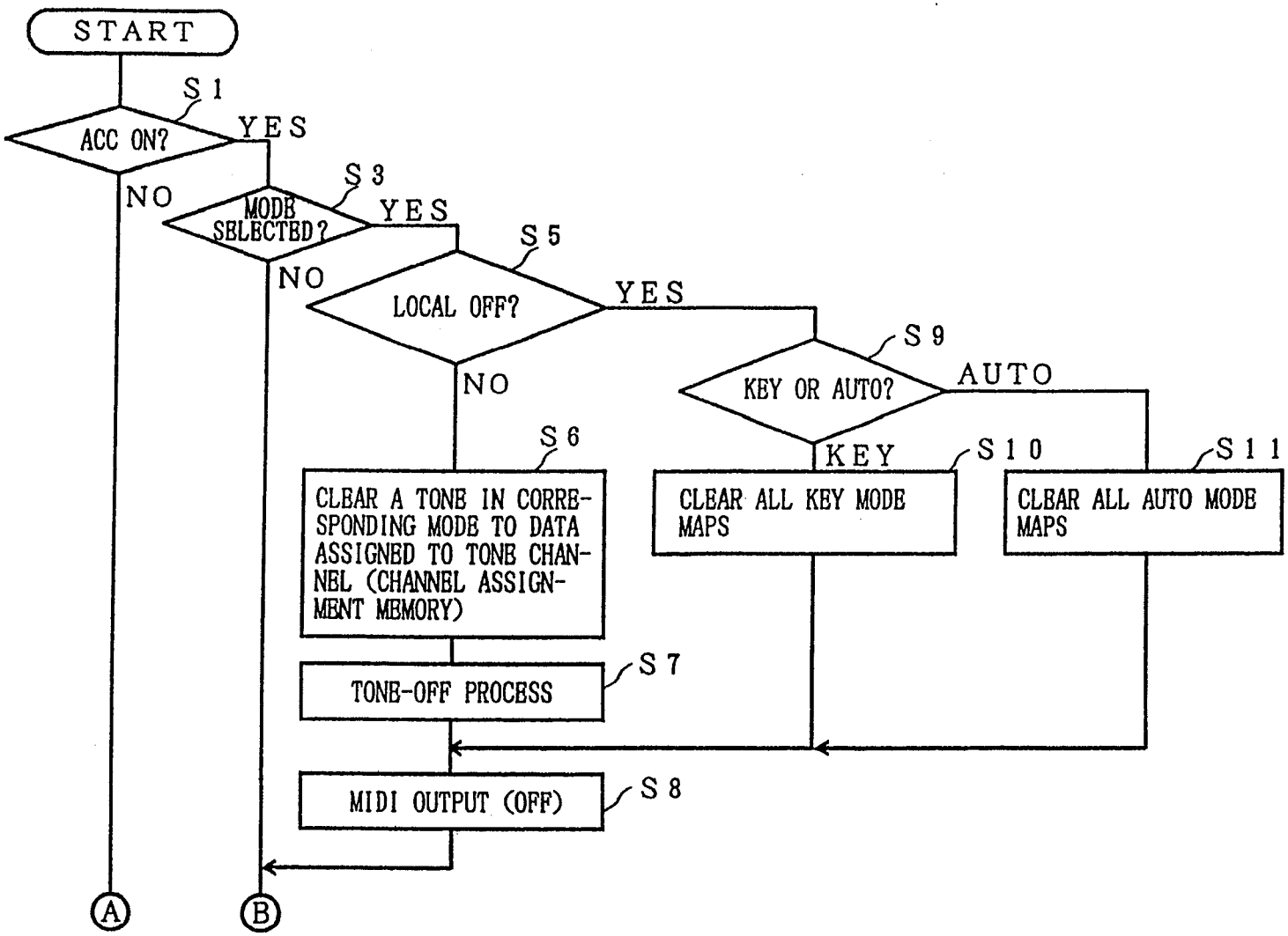
FIG. 5 is flowchart graphically depicting a panel process performed by the electronic musical instrument according to the present invention.
Figure 6:
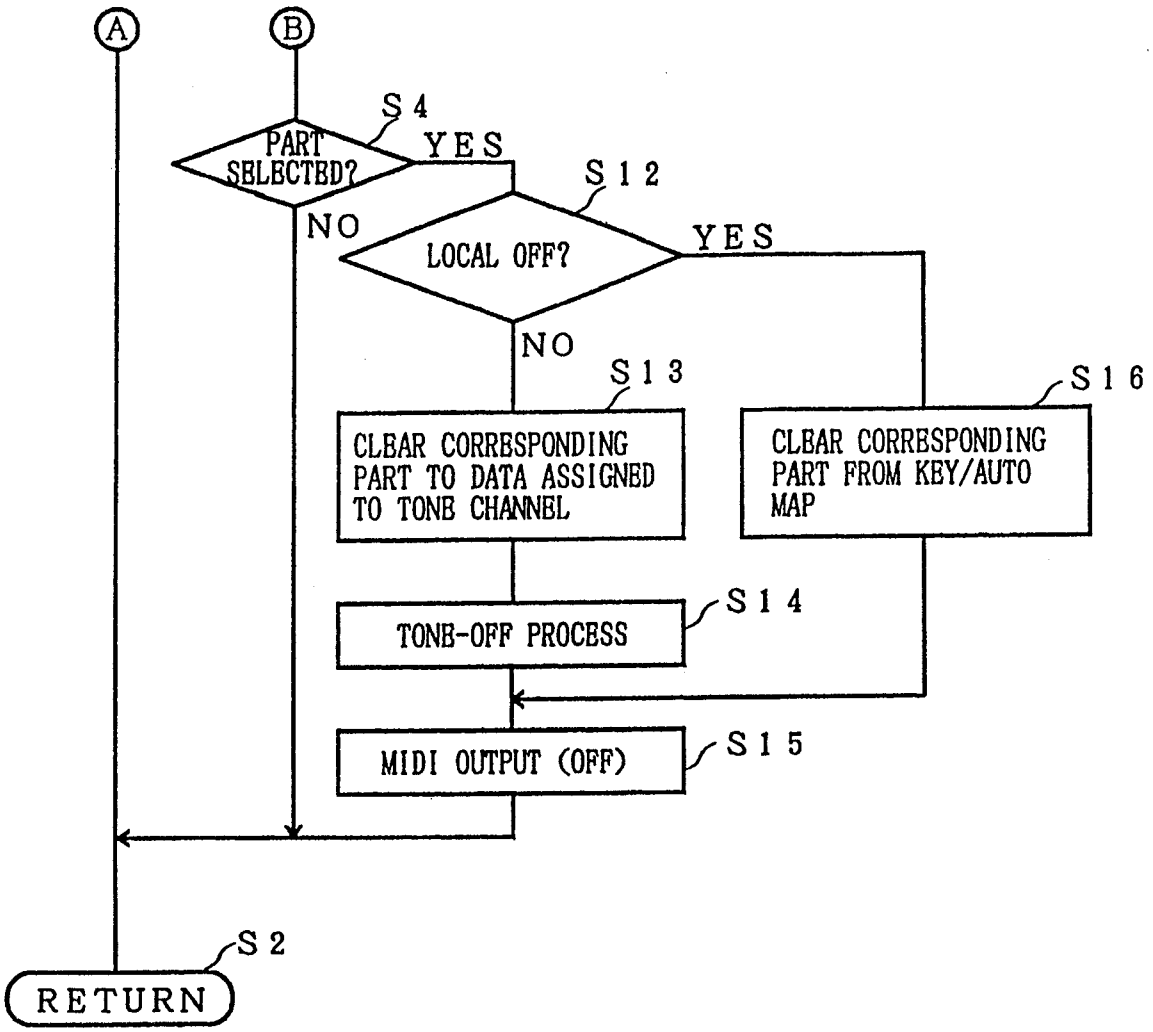
FIG. 6 is a flowchart graphically depicting a panel process performed by the electronic musical instrument according to the present invention.

In the panel operation process, as shown in FIGS. 5 and 6, initially a check is performed to determine whether or not ACC is ON (step S1). When ACC is not ON, panel-associated operation is performed and execution control returns to the main program (step S2).

If, at step at S1, ACC is ON, a check is performed to determine whether a mode has been selected (step S3).

This procedure is employed to determine whether tone data output by the internal tone generating means 3 has been generated by the keyboard scan section 1 or by the automatic play data reading section 2, i.e., to examine a mode for the output tone data and determine whether it is identical to a currently selected mode.

When the mode is identical to the current mode, i.e., when a mode change is not necessary, no procedure is performed and program execution control advances to step S4 where a check is performed to determine whether a part has been altered.

When it is determined that a mode has been altered, program execution advances to step S5 for local-off checking. In this procedure, a check is performed to determine whether the local-off play or the local-on play has been set by the panel operation process.

If local-off play has not been set, a musical tone, from either the keyboard scan section 1 or the automatic play data reading section 2, in a mode corresponding to tone data that is assigned for a tone-on channel in the channel assignment memory 4, is cleared (step S6), and a tone-OFF process for halting tone production is performed (step S7). Then, program execution control advances to the next step, S8, to perform an MIDI output process (OFF).

During this MIDI output process (OFF), all the MIDI outputs that correspond to the musical tone in the mode, which has been cleared, are set to OFF. Program execution control then goes to step S4 to determine whether a part change is necessary.

When the local-off play has been set, program execution control advances to a KEY or AUTO check step (step S9) where a check is performed to determine whether the tone data output by the internal tone generating means 3 is generated by the keyboard scan section 1 or by the automatic play data reading section 2, i.e., to determine the mode for the tone data.

When the tone data output by the internal tone generating means 3 has been generated by the keyboard scan section 1, all the contents of the memory map for the keyboard scan section 1 in the MIDI ON tone memory 7, i.e., the contents of a KEYMODE map, are cleared (step S10). Program execution then goes to step S8 for the MIDI output process (OFF).

When the tone data output by the internal tone generating means 3 has been generated by the automatic play data reading section 2, all the contents of the memory map for the automatic play data reading section 2 in the MIDI ON tone memory 7, i.e., the contents of an AUTOMODE map, are cleared (step S11). Program execution control then goes to step S8 for the MIDI output process (OFF).

In the previously described part selection check (step S4), a check is performed to determine whether tone data from the internal tone generating means 3 designates one of the parts, bass, chord, sound 1 or sound 2, and whether the designated part corresponds to a part that is currently set. When the tone data part corresponds to the current part, i.e., when no part change is necessary, no processing is performed and program execution control returns to the previously described main routine to perform the other panel operation related processes.

When the part has been altered, program execution control advances to step S12 for local-off checking.

In this procedure, a check is performed to determine whether the local-off play or the local-on play has been set by the panel operation process. If the local-off play has not been set, the part designated by tone data, which is assigned for a tone-on channel in the channel assignment memory 4, is cleared (step S13), and a tone-OFF process for halting tone production is performed (step S14). Then, program execution control goes to the next step S15 for an MIDI output process (OFF).

If the local-off play has been set, although tone data output by the internal tone generating means 3 is generated by either the keyboard scan section 1 or the automatic play data reading section 2, all the contents of both the memory map for the keyboard scan section 1 in the MIDI tone memory 7, i.e., the KEYMODE map, and the memory map for the automatic play data reading section 2, i.e., the AUTOMODE map, are cleared (step S16). Program execution control then goes to step S15 for the MIDI output process (OFF).

In this procedure, at step S15, all the MIDI outputs that correspond to the musical tones for the parts that have been cleared in the previous process are set to OFF. Program control then goes to step S2 and returns to the main routine to perform the other panel operation related processes.

Figure 7:
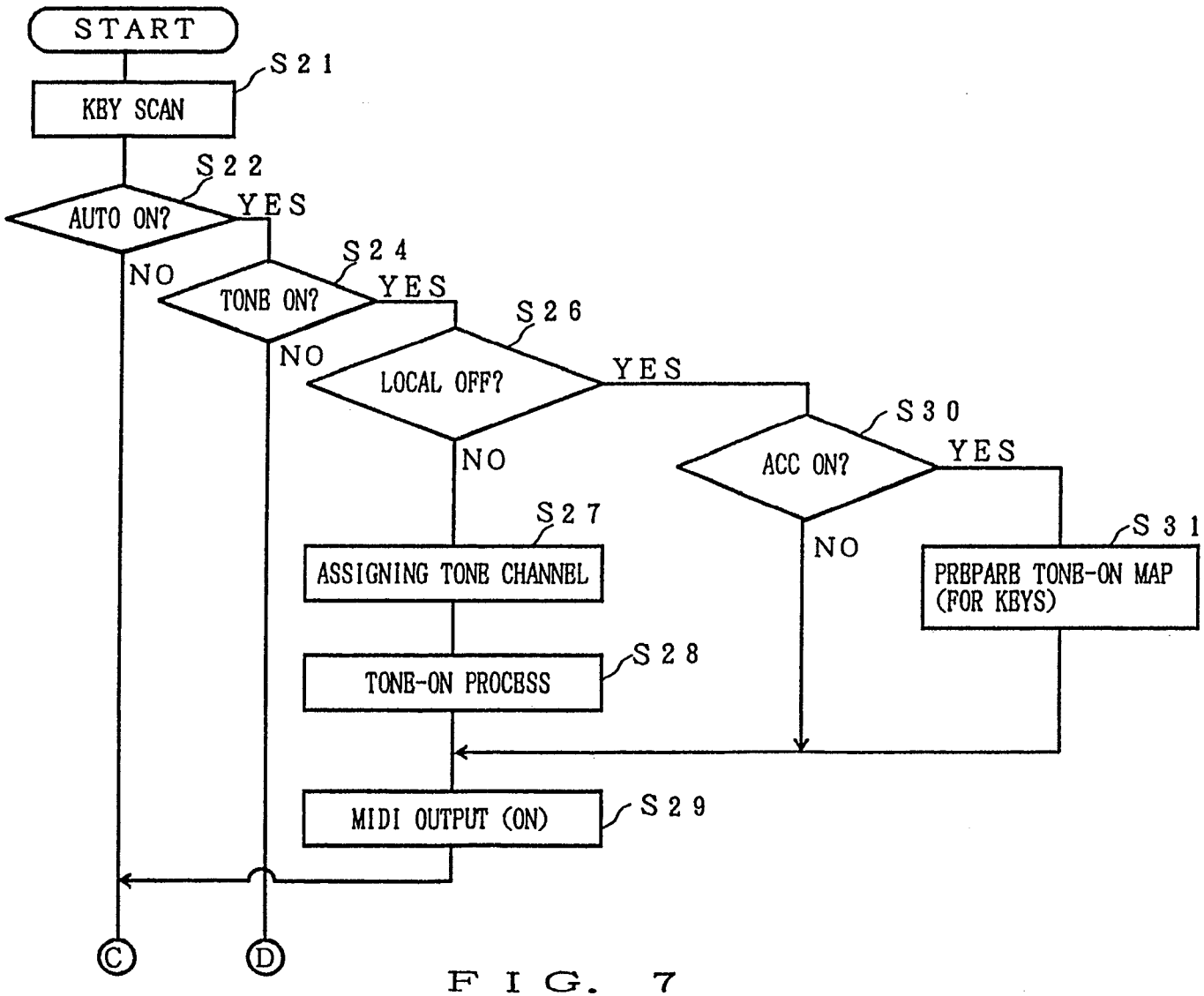
FIG. 7 is a flowchart graphically depicting a key scan/event process performed by the electronic musical instrument according to the present invention.
Figure 8:
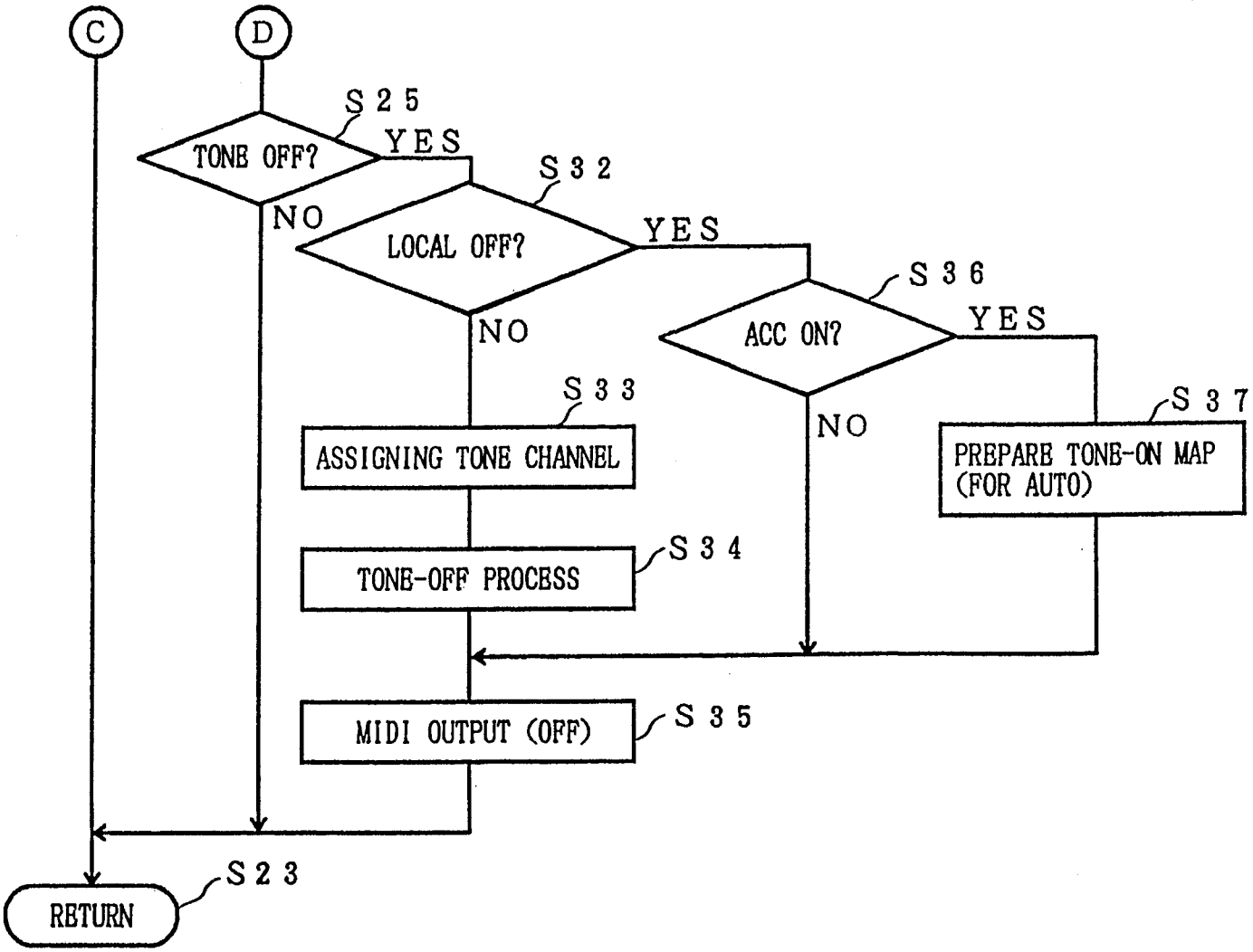
FIG. 8 is a flowchart graphically depicting a key scan/event process performed by the electronic musical instrument according to the present invention.

In the key scan/event processing, as shown in FIGS. 7 and 8, a key scan process (step S21) is performed to examine the operation state of the keyboard keys of the keyboard scan section 1.

Sequentially, a check is then performed to determine whether or not a keyboard key has been manipulated, i.e., whether or not an event has occurred (step S22). When an event has not occurred, program execution control returns to the main routine (step S23).

If, at step S22, an event has occurred, a check is performed to determine the state of the key that was found to have been manipulated during the key scan process (step S24).

In this procedure, the state of the manipulated key is examined. If that key is not in the tone-ON state, i.e., it is in the key-OFF state, and no tone production will be performed, program execution control goes to the tone-off check step (step S25).

If the keyboard key being manipulated is currently in the tone-ON state, i.e., it is in the key-ON state, and tone production will be performed, program execution goes to a step for a local-off check (step S26).

At this step, a check is performed to determine whether local-off play or local-on play has been set during the panel operation process. When local-off play is not set, a tone-on channel is assigned to tone data that corresponds to the manipulated keyboard key in the channel assignment memory 4 (step S27), and tone production for that tone data is performed (step S28). Program execution control then advances to the next step for an MIDI output process (ON) (step S29).

In the MIDI output process (ON), all the MIDI outputs that correspond to the tone data for which tone production is being performed are set to ON- Program control then returns to the main routine (step S23).

If the local-off play is set, a check is performed to determine whether or not ACC is ON (step S30). When ACC is not ON, program control goes to step S29 for the MIDI output process (ON), then goes to step S23 and returns to the main routine.

If, at step S30, ACC is ON, a memory map for the keyboard scan section 1 in the MIDI ON tone memory 7, i.e., the KEYMODE map, is prepared for the tone data for the manipulated keyboard key (step S31). Program execution control then goes to step S29 for the MIDI output process (ON), as it does when ACC is not ON, and then goes to step S23 and returns to the main routine.

At step S25, where the tone-OFF state is examined, the state of the manipulated keyboard key is examined to determine if it is OFF. When the state of the key is not OFF, i.e., tone production is not halted, program control returns to the main routine (step S23).

When the state of the manipulated keyboard key is currently OFF, i.e., the key is OFF and tone production is halted, program control goes to step S32 to check a local-off condition.

At this step, a check is performed to determine whether local-off play or local-on play has been set during the panel operation process. When local-off play is not set, a tone-on channel is assigned to tone data that corresponds to the manipulated keyboard key in the channel assignment memory 4 (step S33), and tone production for that tone data is halted (step S34). Program execution control then advances to the next step for an MIDI output process (OFF) (step S35).

In the MIDI output process (OFF) at step S35, all the MIDI outputs that correspond to the tone data for which tone production is being performed are set to OFF. Program control then returns to the main routine (step S23).

If the local-off play is set, a check is performed to determine whether or not ACC is ON (step S36). When ACC is not ON, program control goes to step S35 for the MIDI output process (OFF), and then returns to the main routine (step S23).

If, at step S36, ACC is ON, a memory map for the keyboard scan section 1 in the MIDI ON tone memory 7, i.e., the KEYMODE map, is prepared for the tone data for the manipulated keyboard key (step S37). Program execution control then goes to step S35 for the MIDI output process (OFF), as it does when ACC is not ON, and then returns to the main routine (step S23).

Figure 9:
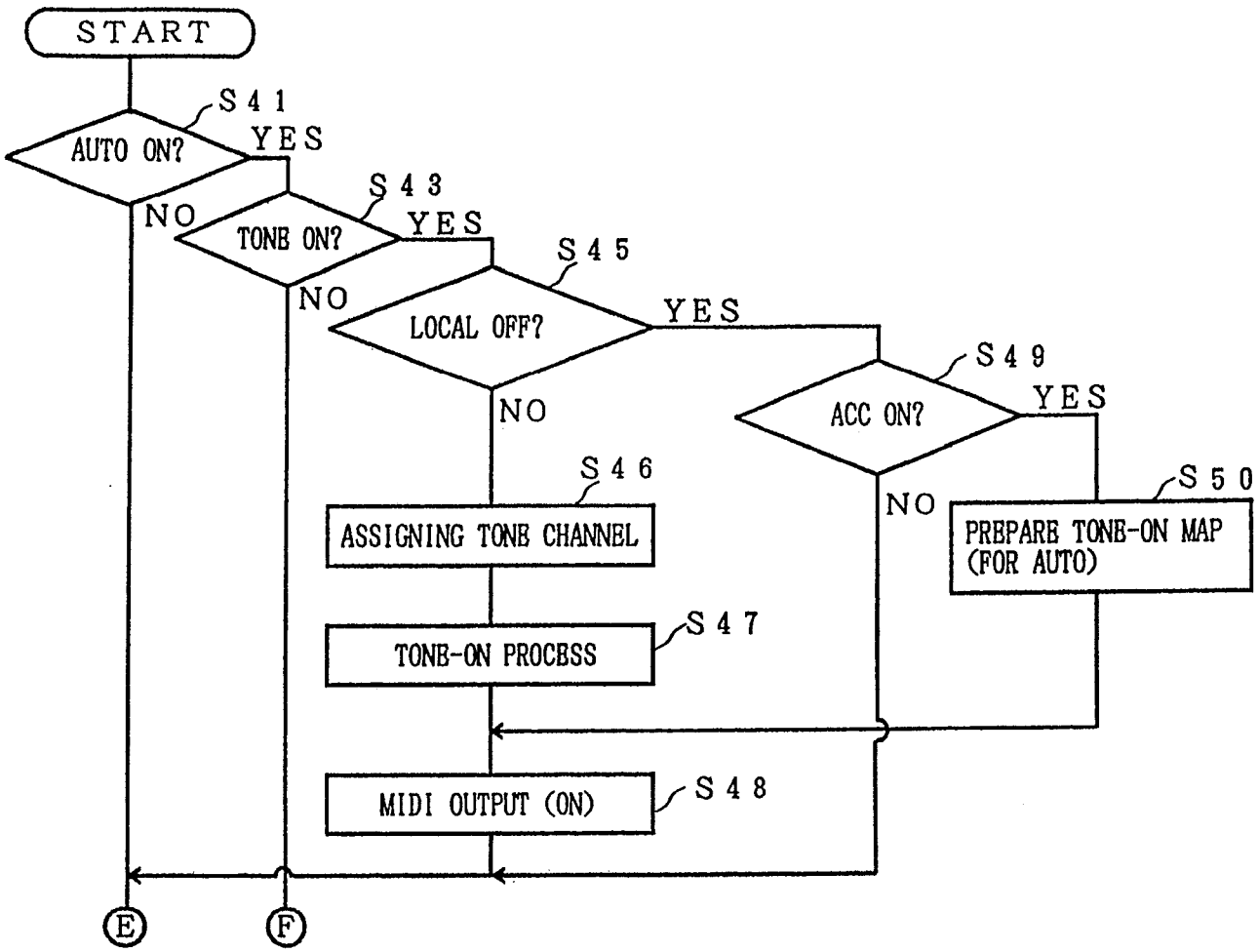
FIG. 9 is a flowchart graphically depicting an automatic play reproduction process performed by the electronic musical instrument according to the present invention.
Figure 10:
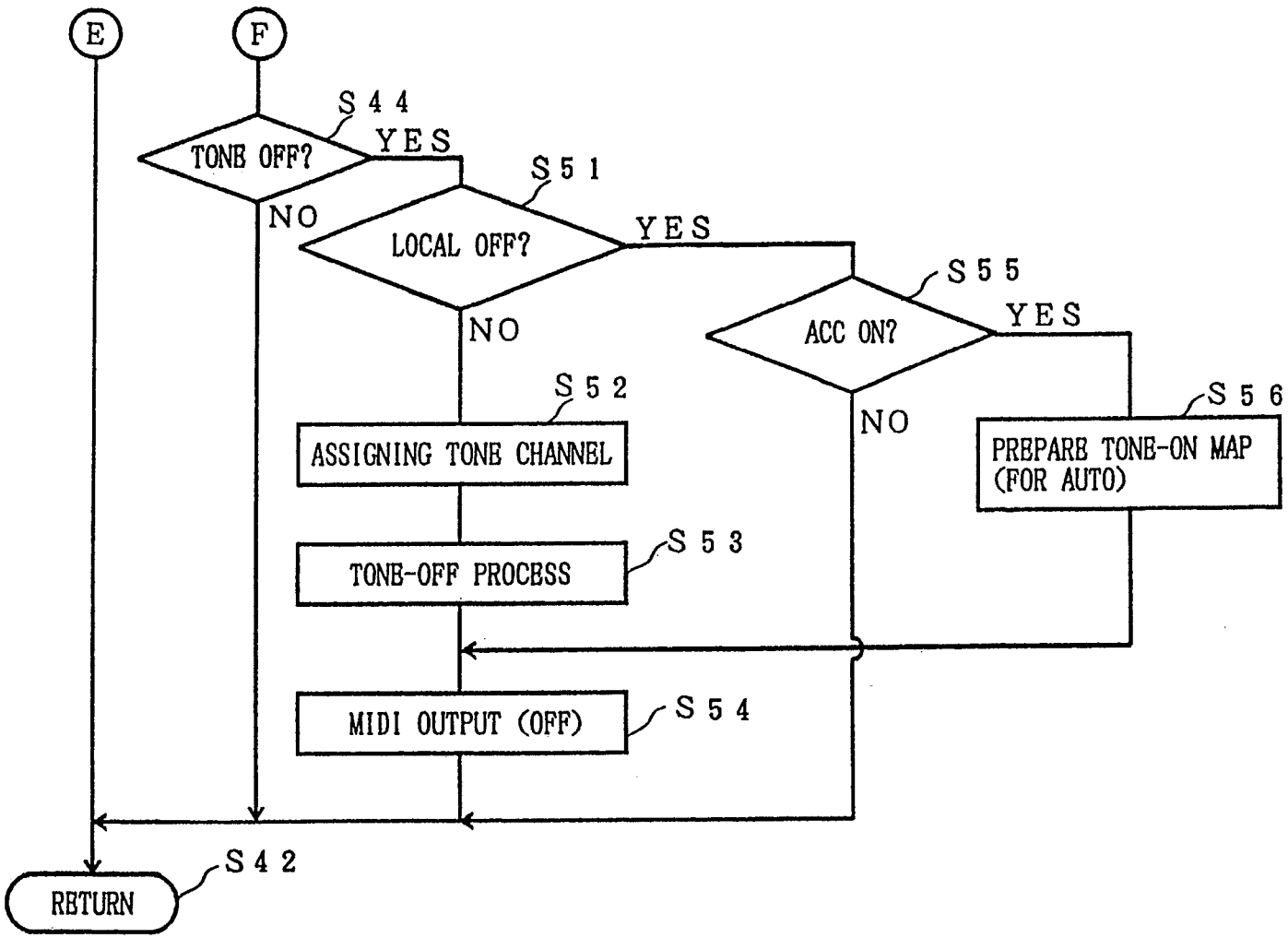
FIG. 10 is a flowchart graphically depicting an automatic play reproduction process performed by the electronic musical instrument according to the present invention.

In the automatic play reproduction, as shown in FIGS. 9 and 10, an AUTO-on check is performed, i.e., the operation state of the automatic play data reading section 2 is examined (step S41).

When AUTO is not ON, program execution control advances to step S42 and returns to the main routine. When, at step S41, AUTO is ON, program execution control goes to a tone-on check step (step S43) for the automatic play data reading section 2 that is assumed to be in the active state.

In this procedure, the state of the automatic play data reading section 2 is examined. If the automatic play data reading section 2 is not in the tone-ON state, i.e., it is inactive, and no tone production will be performed, program execution control goes to the tone-off check step (step S44).

If the automatic play data reading section 2 is currently in the tone-ON state, i.e., it is in the active state, and tone production will be performed, program execution goes to a step for a local-off check (step S45).

At this step, a check is performed to determine whether local-off play or local-on play has been set during the panel operation process. When local-off play is not set, a tone-on channel is assigned to tone data sent by the automatic play data reading section 2 in the channel assignment memory 4 (step S46), and tone production for that tone data is performed (step S47). Program execution control then advances to the next step for an MIDI output process (ON) (step S48).

In the MIDI output process (ON), all the MIDI outputs that correspond to the tone data for which tone production is being performed are set to ON. Program control then goes to step S42 and returns to the main routine.

If the local-off play is set, a check is performed to determine whether or not ACC is ON (step S49). When ACC is not ON, program control goes to step S42 and returns to the main routine.

If, at step S49, ACC is ON, a memory map for the automatic play data reading section 2 in the MIDI ON tone memory 7, i.e., the AUTOMODE map, is prepared for the tone data for the automatic play data reading section 2 (step S50). Program execution control then goes to step S48 for the MIDI output process (ON), then goes to step S42 and returns to the main routine.

At step S44, where the tone-OFF state is examined, the state of the automatic play data reading section 2 is examined to determine if it is OFF. When the state of the automatic play data reading section 2 is not OFF, i.e., tone production is not halted, program control goes to step S42 and returns to the main routine.

When the state of the automatic play data reading section 2 is currently OFF, i.e., the automatic play data reading section 2 is OFF and tone production is halted, program control goes to step S51 to check a local-off condition.

At this step, a check is performed to determine whether local-off play or local-on play has been set during the panel operation process. When local-off play is not set, a tone-on channel is assigned to tone data sent from the automatic play data reading section 2 in the channel assignment memory 4 (step S52), and tone production halt for that tone data is performed (step S53). Program execution control then advances to the next step for an MIDI output process (OFF) (step S54).

In the MIDI output process (OFF) at step S54, all the MIDI outputs that correspond to the tone data for which tone production is being performed are set to OFF. Program control then returns to the main routine (step S42).

If the local-off play is set, a check is performed to determine whether or not ACC is ON (step S55). When ACC is not ON, program control goes to step S42 and returns to the main routine.

If, at step S55, ACC is ON, a memory map for the automatic play data reading section 2 in the MIDI ON tone memory 7, i.e., the AUTOMODE map, is prepared for the tone data for the automatic play data reading section 2 (step S56). Program execution control then goes to step S54 for the MIDI output process (OFF), and returns to the main routine (step S42).

As described above, in contrast to a conventional electronic musical instrument that incorporates automatic playing means to perform automatic playing by employing automatic play data, to externally output an MIDI signal for tone data that is generated by an automatic play data generator of the automatic playing means, an electronic musical instrument according to the present invention erases the registered tone data, which were generated by a keyboard tone generator or the automatic play data generator and which are currently employed for tone production, and selects and newly registers tone data that will be employed for tone production. These requisite processes are required to be performed concurrently with mode selection, for activation of either the keyboard tone generator or the automatic play data generator, and mode/part selection, of a tone quality, a timbre, etc., by panel operation means. More specifically, regardless of the local-on playing or local-off playing state, an electronic musical instrument of the present invention can perform an assigner process, that is, a tone-on channel assignment process, to store the ON/OFF state of the tone data. Therefore, the local-off play function can be performed to independently output to an external device, as an MIDI signal, tone data that are produced by the automatic play data generator. Further, the electronic musical instrument can perform a local-off play function during which it does not employ tone data that it generates, which includes tone data generated by the automatic play data generator, to produce musical tones, but externally outputs such data as independent MIDI signals.

Although the preferred embodiment of the present invention and the claims particularly point out the subject matter regarded as the invention, various other modifications are contemplated as being within the scope of the invention.

What is claimed is:

1. An electronic musical instrument, which includes internal tone generating means, a local-on play function, which produces musical tones in consonance with tone data generated by said internal tone generating means, and a local-off play function, which externally outputs only an MIDI signal without performing tone production in consonance with tone data generated by said internal tone generating means, comprising:

first tone information storage means for, when said local-on play function is selected, storing a channel that corresponds to tone data, which are generated by said internal tone generating means, for each of said tone data;

tone-on channel assigning means for employing said tone information, which are stored in said first storage means, to specify a channel that corresponds to said tone data generated by said internal tone generating means;

tone generating means, which is connected to said tone channel assigning means, for producing a musical tone in consonance with said tone data from said tone-on channel assigning means;

second tone information storage means for, when said local-off play function is selected, successively storing the ON/OFF states of tone data generated by said internal tone generating means for each set of said tone data;

local-off tone data control means for employing said tone information stored in said second tone information storage means to output, as tone data for an MIDI signal, said tone data that is generated by said internal tone generating means without performing either tone channel assignment or tone production for said tone data; and MIDI signal output means, which is connected to said tone channel assigning means and said local-off tone data control means, for outputting, as MIDI signals, tone data from said tone channel assigning means and tone data from said local-off tone data control means.

2. An electronic musical instrument according to claim 1, further comprising panel operation means, connected to said tone-on channel assignment means and said local-off tone data control means, for selecting and controlling said tone-on channel assignment means and said local-off tone data control means.

3. An electronic musical instrument according to claim 1 wherein said internal tone generating means comprises a keyboard tone generator and an automatic play data generator.

4. An electronic musical instrument according to claim 3, wherein an OFF signal is added to all the tone information, to halt musical tones being produced, when an operation mode of said automatic play data generator is changed from active to non-active.

5. An electronic musical instrument according to claim 3 wherein, when only said keyboard tone generator in said internal tone generating means is selected by said panel operation means, as for local-on playing, normal tone-on playing is performed via said tone-on channel assignment means and said tone generating means to produce musical tones employing tone data sent from said keyboard tone generator, and, as for local-off playing, said tone data from said keyboard tone generator is directly sent to said MIDI signal output means without passing through said tone-on channel assignment means and said tone generating means in order to prevent said tone data from being employed for tone production.

6. An electronic musical instrument according to claim 3 wherein, when only said automatic play data generator in said internal tone generating means is selected by said panel operation means, as for local-on playing, normal playing is performed by said tone-on channel assignment means and said tone generating means to produce musical tones employing tone data sent from said automatic play data generator, and, as for local-off playing, said tone data from said automatic play data generator is sent to said MIDI signal output means via said local-off tone data control means, which is controlled in consonance with tone information stored in said second tone information storage means, without passing through said tone-on channel assignment means and said tone generating means in order to prevent said tone data from being employed for tone production.

7. An electronic musical instrument according to claim 3, wherein, when both said keyboard tone generator and said automatic play data generator in said internal tone generating means are selected by said panel operation means, as for local-on playing, normal playing is performed by said tone-on channel assignment means and said tone generating means to produce musical tones employing tone data sent from both said keyboard tone generator and said automatic play data generator, and, as for local-off playing, said tone data from both said keyboard tone generator and said automatic play data generator are sent to said MIDI signal output means via said local-off tone data control means, which is controlled in consonance with tone information stored in said second tone information storage means, without passing through said tone-on channel assignment means and said tone generating means in order to prevent said tone data from being employed for tone production.

8. An electronic musical instrument according to one of claim 3, wherein tone information, stored in said second tone information storage means, serves as memory maps that correspond to all the keyboard keys, for a mode for activating said keyboard tone generator, for a mode for activating said automatic play data generator, and for every part.

9. An electronic musical instrument according to claim 2, wherein said internal tone generating means comprises a keyboard tone generator and an automatic play data generator.

10. An electronic musical instrument according to claim 9, wherein an OFF signal is added to all the tone information, to halt musical tones being produced, when an operation mode of said automatic play data generator is changed from active to non-active.

11. An electronic musical instrument according to claim 4, wherein, when only said keyboard tone generator in said internal tone generating means is selected by said panel operation means, as for local-on playing, normal tone-on playing is performed via said tone-on channel assignment means and said tone generating means to produce musical tones employing tone data sent from said keyboard tone generator, and, as for local-off playing, said tone data from said keyboard tone generator is directly sent to said MIDI signal output means without passing through said tone-on channel assignment means and said tone generating means in order to prevent said tone data from being employed for tone production.

12. An electronic musical instrument according to claim 10, wherein, when only said keyboard tone generator in said internal tone generating means is selected by said panel operation means, as for local-on playing, normal tone-on playing is performed via said tone-on channel assignment means and said tone generating means to produce musical tones employing tone data sent from said keyboard tone generator, and, as for local-off playing, said tone data from said keyboard tone generator is directly sent to said MIDI signal output means without passing through said tone-on channel assignment means and said tone generating means in order to prevent said tone data from being employed for tone production.

13. An electronic musical instrument according to claim 4, wherein, when only said automatic play data generator in said internal tone generating means is selected by said panel operation means, as for local-on playing, normal playing is performed by said tone-on channel assignment means and said tone generating means to produce musical tones employing tone data sent from said automatic play data generator, and, as for local-off playing, said tone data from said automatic play data generator is sent to said MIDI signal output means via said local-off tone data control means, which is controlled in consonance with tone information stored in said second tone information storage means, without passing through said tone-on channel assignment means and said tone generating means in order to prevent said tone data from being employed for tone production.

14. An electronic musical instrument according to claim 10, wherein, when only said automatic play data generator in said internal tone generating means is selected by said panel operation means, as for local-on playing, normal playing is performed by said tone-on channel assignment means and said tone generating means to produce musical tones employing tone data sent from said automatic play data generator, and, as for local-off playing, said tone data from said automatic play data generator is sent to said MIDI signal output means via said local-off tone data control means, which is controlled in consonance with tone information stored in said second tone information storage means, without passing through said tone-on channel assignment means and said tone generating means in order to prevent said tone data from being employed for tone production.

15. An electronic musical instrument according to claim 4, wherein, when both said keyboard tone generator and said automatic play data generator in said internal tone generating means are selected by said panel operation means, as for local-on playing, normal playing is performed by said tone-on channel assignment means and said tone generating means to produce musical tones employing tone data sent from both said keyboard tone generator and said automatic play data generator, and, as for local-off playing, said tone data from both said keyboard tone generator and said automatic play data generator are sent to said MIDI signal output means via said local-off tone data control means, which is controlled in consonance with tone information stored in said second tone information storage means, without passing through said tone-on channel assignment means and said tone generating means in order to prevent said tone data from being employed for tone production.

16. An electronic musical instrument according to claim 10, wherein, when both said keyboard tone generator and said automatic play data generator in said internal tone generating means are selected by said panel operation means, as for local-on playing, normal playing is performed by said tone-on channel assignment means and said tone generating means to produce musical tones employing tone data sent from both said keyboard tone generator and said automatic play data generator, and, as for local-off playing, said tone data from both said keyboard tone generator and said automatic play data generator are sent to said MIDI signal output means via said local-off tone data control means, which is controlled in consonance with tone information stored in said second tone information storage means, without passing through said tone-on channel assignment means and said tone generating means in order to prevent said tone data from being employed for tone production.

* * * * *